US005093938A

United States Patent [19]

Kamata

[11] Patent Number: 5,093,938

[45] Date of Patent: Mar. 10, 1992

[54] HELMET FOR RIDING VEHICLE

[75] Inventor: Eitaro Kamata, Tokyo, Japan

[73] Assignee: Shoei Kako Kabushiki Kaisha, Tokyo, Japan

[21] Appl. No.: 627,102

[22] Filed: Dec. 13, 1990

[30] Foreign Application Priority Data

Aug. 31, 1990 [JP] Japan ..... 2-230150

[51] Int. Cl.[5] ..... A42B 1/08

[52] U.S. Cl. ..... 2/424; 2/171.3

[58] Field of Search ..... 2/171.3, 410, 411, 424, 2/425

[56] References Cited

U.S. PATENT DOCUMENTS

| | | | |
|---|---|---|---|
| 4,514,864 | 5/1985 | Huber | 2/424 |
| 4,524,465 | 6/1985 | Huber | 2/424 |
| 4,538,303 | 9/1985 | Schnitzler | 2/424 |
| 4,612,675 | 9/1986 | Broersma | 2/424 |
| 4,615,052 | 10/1986 | Nava | 2/424 |
| 4,667,348 | 5/1987 | Sundahl | 2/410 |
| 4,731,885 | 3/1988 | Nava | 2/424 |

FOREIGN PATENT DOCUMENTS

| | | | |
|---|---|---|---|
| 268549 | 5/1988 | European Pat. Off. | 2/410 |
| 3607223 | 7/1987 | Fed. Rep. of Germany | 2/424 |
| 64-30322 | 2/1989 | Japan . | |
| 73923 | 6/1974 | Taiwan . | |
| 2198925 | 6/1988 | United Kingdom | 2/424 |

*Primary Examiner*—Werner H. Schroeder
*Assistant Examiner*—Michael A. Neas
*Attorney, Agent, or Firm*—Armstrong, Nikaido, Marmelstein, Kubovcik & Murray

[57] ABSTRACT

A helmet has a chin cover portion formed immediately below a window opening of a front of a cap body. A recess is formed on a front surface of a shell at the chin cover portion. A housing covers the recess and opens at an upper end to the window opening. The housing is secured to the shell. Air intake holes are formed at the housing. A distribution chamber and a plurality of air introducing ducts are defined between the housing and a bottom of the recess. The ducts upwardly extend from the distribution chamber and communicate with a plurality of jet holes. The distribution chamber of a large volume can be formed without impairing the strength of a buffer liner inside the shell. The air introduced from the air intake holes can be reliably jetted out to the inner surface of the shield plate which closes the window opening, to prevent a cloud forming on the inner surface of the shield plate.

2 Claims, 4 Drawing Sheets

HELMET FOR RIDING VEHICLE

BACKGROUND OF THE INVENTION

1. FIELD OF THE INVENTION

The field of the invention is a helment used by a rider of a motorcycle or the like vehicle and, more particularly, an improvement in such a helmet comprising a cap body which is formed of a shell with a buffer liner fitted therein and which includes a chin cover portion located immediately below a window opening. An edge member is fitted on a peripheral edge of the shell around the window opening. A shield plate, for closing the window opening by coming in contact with the edge member is mounted on the cap body. The chin cover portion of the cap body includes a distribution chamber, an air intake hole for introducing a travelling wind, and a plurality of jet holes for jetting out the air within the distribution chamber toward an inner surface of the shield plate, thereby preventing clouding of the inner surface of the shield plate with the air spouted from the jet holes.

2. Description of the Prior Art

There is conventionally known a helmet in which, for example, a recess is formed in a buffer liner of a chin cover portion on a surface thereof opposed to a shell, and the recess is used as a distribution chamber (as disclosed in Japanese Utility Model Laid-Open No. 64-30322).

It is preferable to increase the volume of a distribution chamber as large as possible so as to uniformly jet out a travelling wind introduced into a distribution chamber from a plurality of jet holes. However, in order to increase the volume of the distribution chamber in a conventional helmet having the structure as described above, the recess of the buffer liner must be formed in a large size. In view of a decrease in the strength of the liner due to the large size of the recess, there is a limit for increasing the volume of the chamber.

SUMMARY OF THE INVENTION

The present invention has been accomplished with such circumstances in view. It is an object of the present invention to provide a helmet of the type described above, in which a distribution chamber of a large volume can be formed without impairing a strength of a buffer liner, air taken in the distribution chamber can be reliably regulated and jetted out from jet holes toward an inner surface of a shield plate to effectively prevent a cloud from forming on the inner surface of the shield plate.

To accomplish the above object, according to the present invention, a front surface of the shell at the chin cover portion is formed with a recess. A housing is secured to the shell for covering the recess and having an upper end thereof exposed to the window opening. The air intake holes are formed at the housing. The distribution chamber is defined between the housing and a bottom of the recess. A plurality of air introducing ducts are also defined between the housing and the recess bottom so as to extend upwardly from the distribution chamber and communicate with the plurality of jet holes.

With such a construction, since the distribution chamber is defined with the shell of the chin cover portion and the housing secured to the front surface of the shell, the distribution chamber of large volume can be obtained without impairing the strength of the buffer liner inside the shell. Therefore, the travelling wind introduced from the air intake holes into the distribution chamber can be uniformly distributed through the plurality of air introducing ducts into the plurality of jet holes.

Further, even if a turbulent flow of the intake air occurs in the distribution chamber, the air is rectified while it is divided into the plurality of ducts, then leads to the plurality of jet holes. Consequently, the air can be reliably spouted to the inner surface of the shield plate to enhance the cloud preventing effect of the inner surface of the shield plate.

These and other objects and features of the present invention will become apparent from the following detailed description taken in conjunction with the attached drawings.

DESCRIPTION OF THE PREFERRED EMBODIMENT

The present invention will now be described by way of an embodiment with reference to the accompanying drawings.

Figure 1:
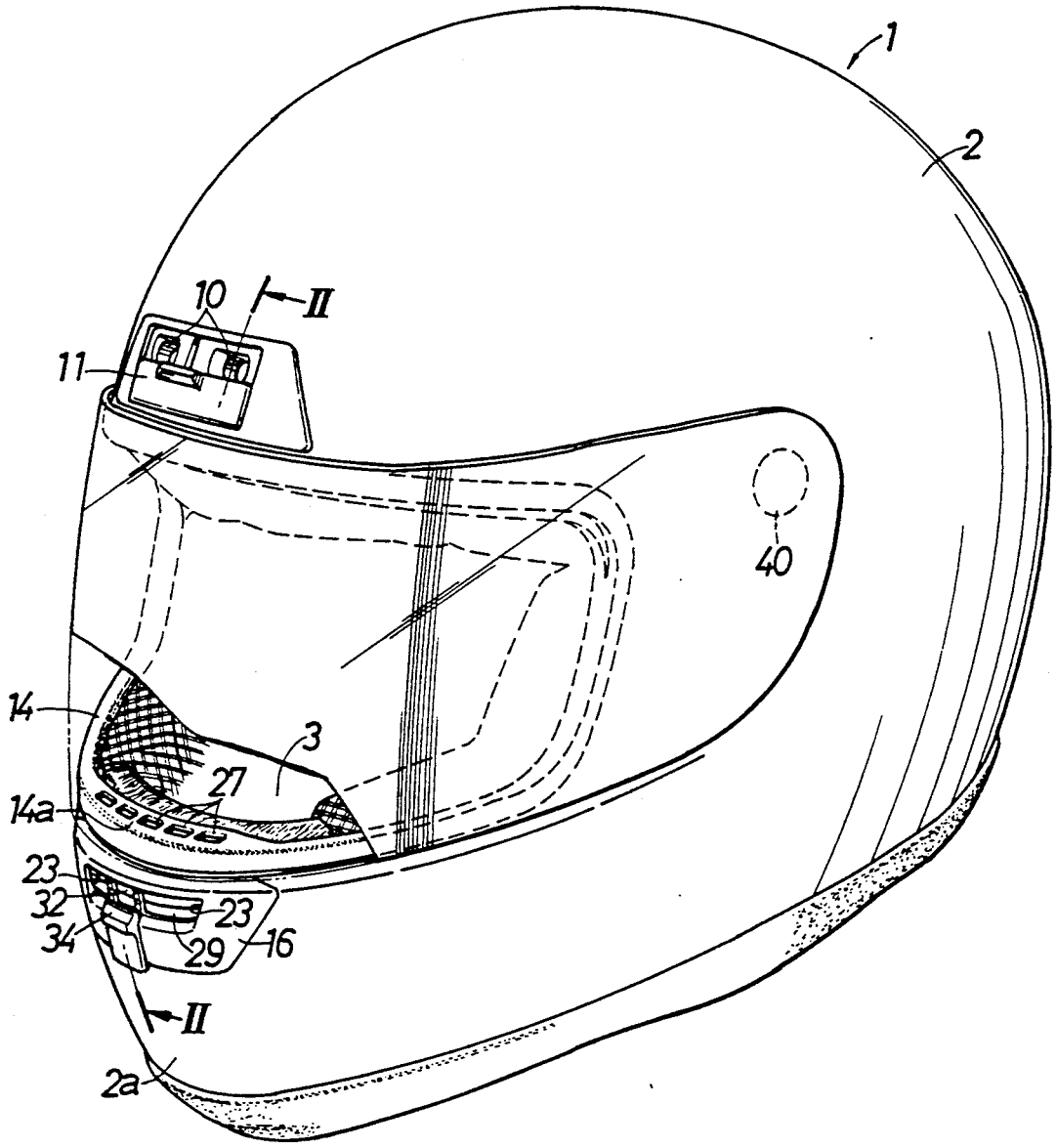
FIG. 1 is a perspective view of a full-face type helmet partly cut out at a shield plate.
Figure 2:
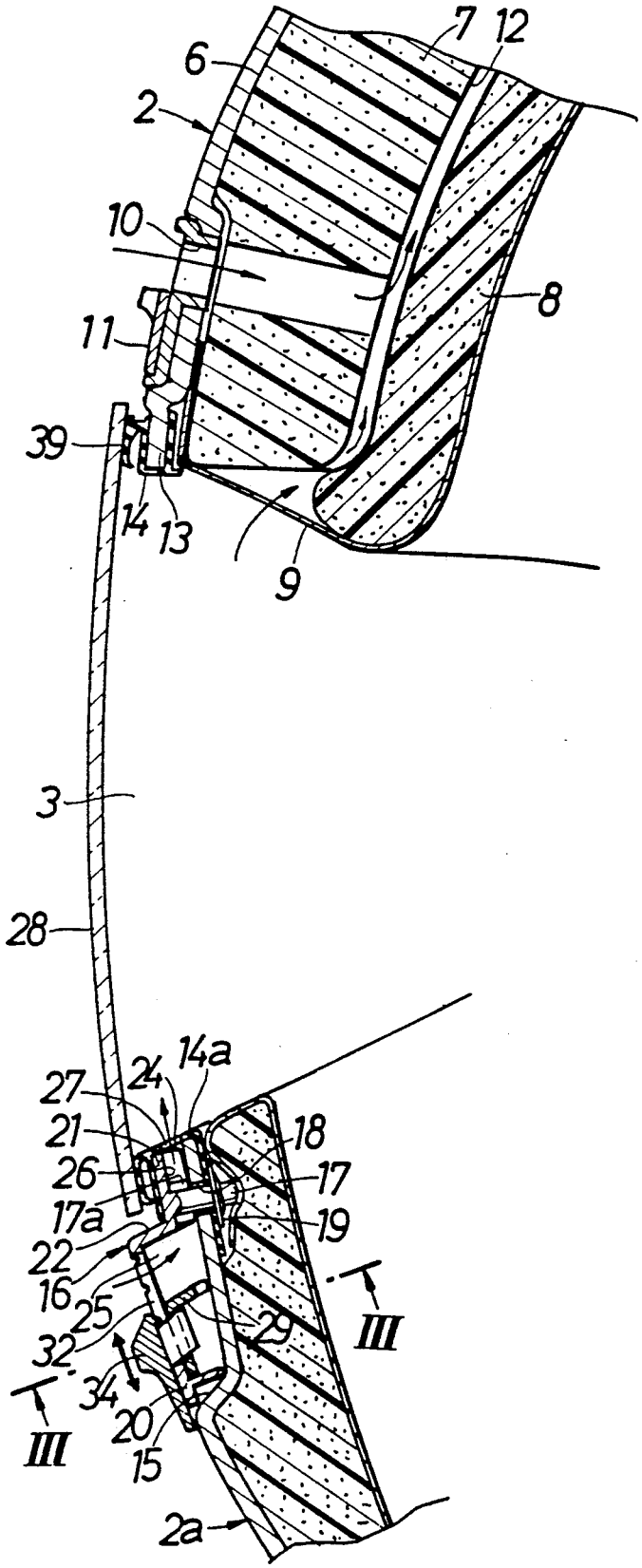
FIG. 2 is a sectional view taken along a line II—II in FIG. 1.

Referring to FIGS. 1 and 2, a cap body 2 of a helmet 1 is composed in a full-face helmet having a chin cover portion 2*a* immediately below a window opening 3 provided in a front of the cap body 2.

The cap body 2 comprises a shell 6 made of FRP (fiber reinforced plastic), and a buffer liner 7 made of foamed polystyrene fitted in the shell 6. An inner pad 8 made of urethane foam is disposed inside an inner surface of the buffer liner 7 excluding a center of the chin cover portion 2*a*. The inner pad 8 is covered with a mesh-like skin 9 having a large air permeation, and the skin 9 is adhered to an outer surface of the buffer liner 7 in the shell 6 for covering a peripheral edge of the buffer liner 7 around the window opening 3.

A pair of air introducing holes 10 are formed at an upper portion of the front wall of the cap body 2, and a shutter 11 for opening and closing the air introducing holes 10 is provided.

The inner ends of the air introducing holes 10 are opened to a plurality of ventilation grooves 12 extended longitudinally in an inner surface of the buffer liner 7. A front end of each of the ventilation grooves 12 is opened at the upper edge of the window hole 3, while a rear end is communicated with a discharge hole (not shown) formed at a rear wall of the cap body 2.

Figure 4:
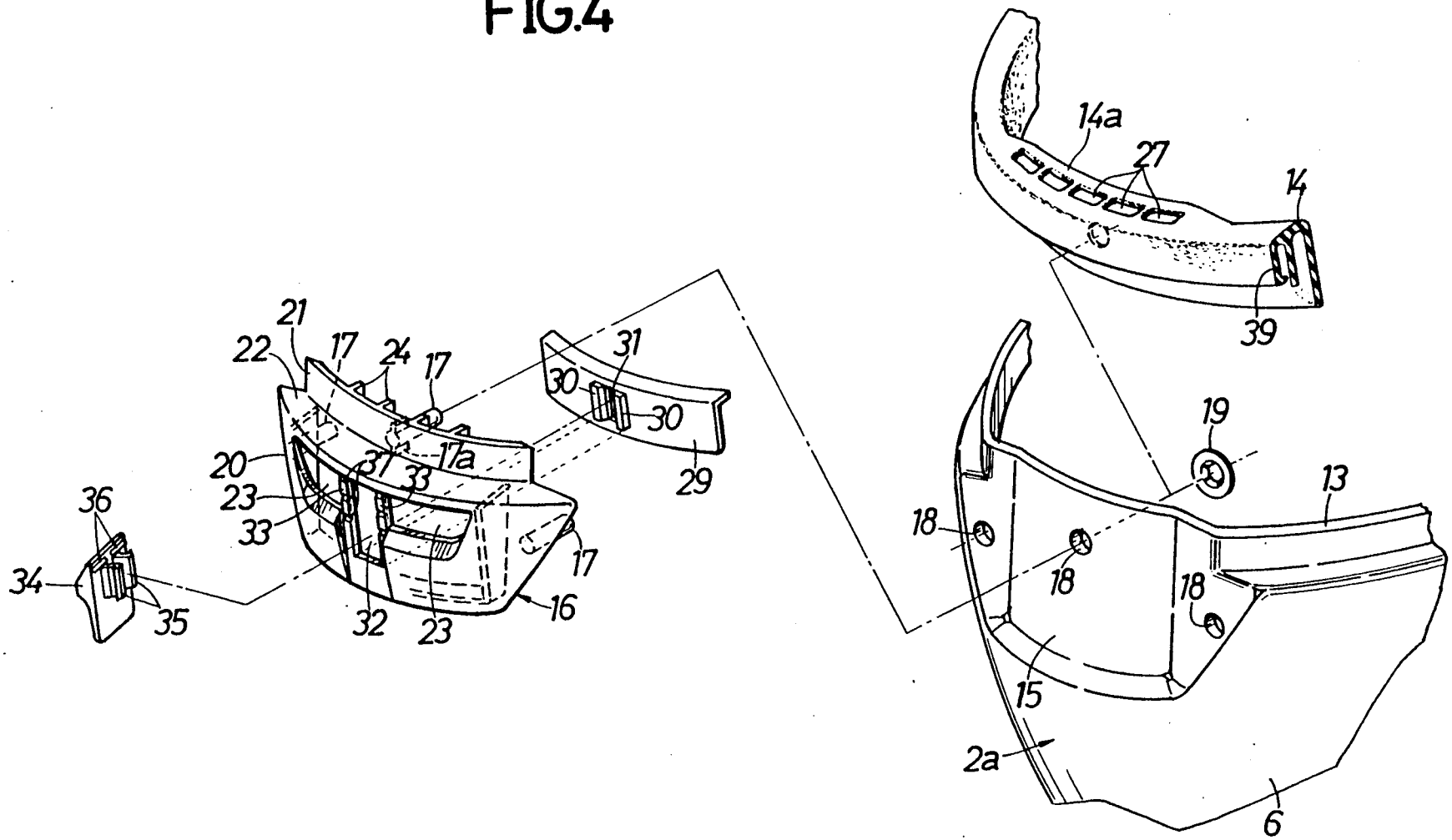
FIG. 4 is an exploded perspective view of the periphery of a chin cover portion.

As shown in FIGS. 2 and 4, a flange 13 located slightly inward of the cap body 2 is formed at the peripheral edge of the window opening 3 of the shell 6, and a channel-like edge member 14 made of rubber is adhesively fitted on the flange 13.

The shell 6 of the chin cover portion 2*a* is provided with a recess 15 at a center of the front face of the shell 6 from an upper edge.to an intermediate portion thereof. Thus, part of the flange 13 is further folded into the cap body 2 and is continuously formed with the bottom wall of the recess 15.

A housing 16 made of synthetic resin is disposed to cover the recess 15 from the front face side thereof. This housing 16 is integrally provided with a plurality of mounting pins 17 projecting from an inner surface of the housing 16. The pins 17 are inserted into a plurality of mounting holes 18 provided in the shell 6 respectively, and locking rings 19 are attached to the pins 17, respectively inside the shell 6. Thus, the housing 16 is mounted on the shell 6. Spacers 17*a* are integrally formed at the peripheral surfaces of the mounting pins 17.

The housing 16 comprises a main body portion 20 flush with an outer surface of the shell 6 except the recess 15, a small flange 21 flush with the flanges 13 of both sides of the recess 15, and a stepped portion 22 for connecting the main body 20 to the small flange 21. A pair of right and left air intake holes 23 are formed in the main body 20, and a plurality of vertically extended partition walls 24 are projected from an inner surface of the small flange 21. A main body portion 20 defines, in cooperation with the bottom of the recess 15, a distribution chamber 25 to which both the air intake holes 23 open. The small flange 21 cooperates with the plurality of partition walls 24 to define, between the flange 21 and the bottom of the recess 15, a plurality of air introducing ducts 26 upwardly extended from the distribution chamber 25.

The edge member 14 is provided with a wide portion 14*a* which is formed by expanding a channel portion of the edge member 14 at a lower center part thereof in the longitudinal direction of the helmet, and jet holes 27 of the same number as the ducts 26 are formed at an upper wall of the wide portion 14*a*. The wide portion 14*a* is fitted on the flange 13 to surround the small flange 21 while covering the upper openings of the plurality of ducts 26. In this case, the jet holes 27 of the wide portion 14*a* are registered with the ducts 26 to jet out air toward an inner surface of a shield plate 28 which will be described later.

Figure 3:
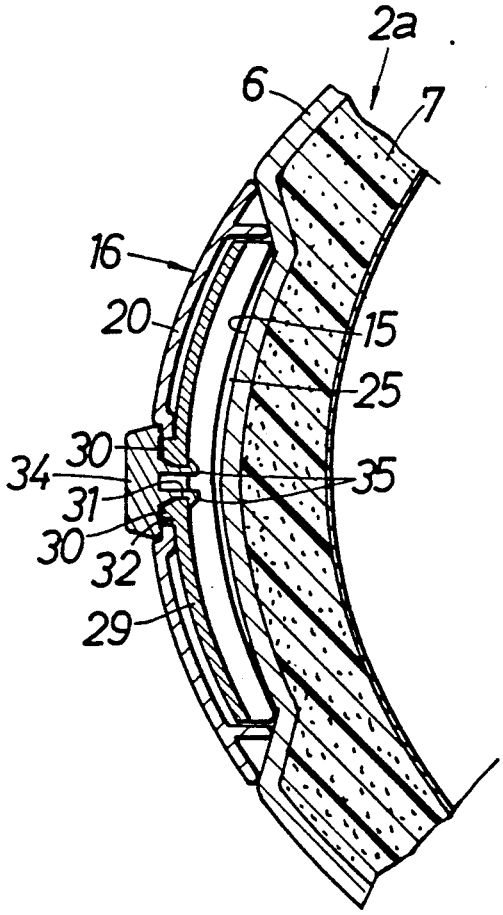
FIG. 3 is a sectional view taken along a line III—III in FIG. 2.

As shown in FIGS. 2 to 4, a lower shutter 29 for opening and closing the air intake holes 23 is disposed in the distribution chamber 25. The lower shutter 29 has a pair of left and right slide projections 30 extending vertically and projected from a front surface of the shutter 29, and a locking hole 31 opened at a location between both the projections 30. A pair of left and right rails 33 are provided on the housing 16 between the left and right air intake holes 23 to sandwich therebetween a vertically elongated rectangular shaped guide and air intake hole 32. A knob 34 is bridged between the rails 33 and 33, and a locking pawl 35 projected from a rear surface of the knob 34 is engaged with the locking hole 31. When the knob 34 is slid upward, the lower shutter 29 is raised to close the air intake holes 23, whereas, when the knob 34 is slid downward, the lower shutter 29 is lowered to open the air intake holes 23.

Three notches 37 to be selectively engaged with the small projections 36 of the knob 34 are formed on both the rails 33 and 33 so as to hold the lower shutter 29 at three positions, i.e., a full-opened position, a halfopened position and a full-closed position.

Referring again to FIG. 2 and 4, a seal lip 39 is integrally formed on a front surface of the edge member 14. A transparent shield plate 28 made of synthetic resin is attached at opposite ends on opposite side walls of the cap body 2 through pivot sections 40 (FIG 1). The shield plate 28 is closely contacted at an inner surface thereof with the seal lip 39 for closing the window opening 3. If the shield plate 28 is turned upwardly around the pivot section 40, the window opening 3 can be opened.

Description will now be made of the operation of this embodiment.

When a rider wearing the helmet 1 leaves the upper shutter 11 open at the time of travelling of a motorcycle in a state that the window opening 3 is closed by the shield plate 28, a travelling wind is introduced from the air introducing holes 10 into the ventilation grooves 12 to ventilate the interior of the cap body 2 while flowing toward a discharge hole (not shown) of the rear portion.

If the lower shutter 29 is left open, the travelling wind is introduced from the air intake holes 23 and the guide and air intake hole 32 into the distribution chamber 25, and is then divided into the plurality of air introducing ducts 26 extending upwardly and regulated thereat. The travelling wind is spouted from the corresponding jet holes 27 toward the inner surface of the shield plate 28. The travelling wind flows upward along the shield plate 28 to prevent a cloud from forming on the inner surface of the shield plate 28.

The air flowing upward along the inner surface of the shield plate 28 is partly passed through the mesh-like skin 9 into the ventilation grooves 12, and the rest of the air is introduced into a gap between the head of the user and the inner pad 8 to promote the ventilation in the cap body 2.

According to this embodiment of the present invention, since the distribution chamber 25 is defined by of the recess 15 on the front surface of the shell 6 of the chin cover portion 2*a* and the housing 16 covering the recess 15, the distribution chamber 25 can be formed easily to have a large volume, and the air can be uniformly distributed to the plurality of air introducing ducts 26. Further, since the buffer liner 7 is disposed in close contact with the inner surface of the shell 6 also at in the chin cover portion 2*a*, its strength is not impaired at all.

Further, since the wide portion 14*a* of the edge member 14 at the peripheral edge of the window opening 3 is formed to cover not only the flange 13 of the shell 6 but also the small flange 21 of the housing 16, the boundary between the flange 13 and the small flange 21 is covered over therey improving its external appearance.

Moreover, since the plurality of jet holes 27 are formed at the wide portion 14*a* of the edge member 14, the wide portion 14*a* serves to function as a jet hole plate, thereby eliminating a separate jet hole plate to simplify the structure.

What is claimed is:

1. A helmet for riding a vehicle, said helmet comprising:

a cap body formed of a shell and a buffer line which is fitted in the shell, said shell including a window opening defined in a front of the cap body and a chin cover portion located immediately below the window opening, a recess is provided on a front surface of the shell at the chin cover portion;

a housing mounted on the shell covering the recess and defining a distribution chamber between a bottom of the recess and the housing and exposing an upper end of the housing to the window opening, the housing provided integrally with (a) an air intake hole located in a front of the housing for introducing a travelling wind into said distribution chamber and (b) a plurality of partition walls for defining a plurality of air introducing ducts between the bottom of the recess and the housing, said air introducing ducts extending upwardly from the distribution chamber and leading to a plurality of jet holes;

a shutter attached to said front of the housing for opening and closing the air intake hole;

an edge member fitted on a peripheral edge of the shell around the window opening, said plurality of jet holes formed in said edge member; and a shield plate attached to the cap body for closing the window opening in contact with the edge member, wherein said plurality of jet holes out air within the distribution chamber toward an inner surface of the shield plate.

2. A helmet for riding a vehicle according to claim 1, wherein said edge member is formed with a wide portion for covering a peripheral edge of the shell at the window opening as well as an upper edge of said housing, said plurality of jet holes being formed at the wide portion.

* * * * *